US007849694B2

(12) United States Patent
Dahlke et al.

(10) Patent No.: US 7,849,694 B2
(45) Date of Patent: Dec. 14, 2010

(54) HEAT SHIELD ARRANGEMENT FOR A COMPONENT GUIDING A HOT GAS IN PARTICULAR FOR A COMBUSTION CHAMBER IN A GAS TURBINE

(75) Inventors: Stefan Dahlke, Mülheim a.d. Ruhr (DE); Heinrich Pütz, Much (DE)

(73) Assignee: Siemens Aktiengesellschaft, Munich (DE)

( * ) Notice: Subject to any disclaimer, the term of this patent is extended or adjusted under 35 U.S.C. 154(b) by 1157 days.

(21) Appl. No.: 10/568,115

(22) PCT Filed: Jul. 20, 2004

(86) PCT No.: PCT/EP2004/008116

§ 371 (c)(1),
(2), (4) Date: Aug. 14, 2006

(87) PCT Pub. No.: WO2005/019730

PCT Pub. Date: Mar. 3, 2005

(65) Prior Publication Data

US 2009/0077974 A1 Mar. 26, 2009

(30) Foreign Application Priority Data

Aug. 13, 2003 (EP) ..... 03018415

(51) Int. Cl.
*F02C 1/00* (2006.01)

(52) U.S. Cl. ..... 60/756; 60/752

(58) Field of Classification Search ..... 60/752–760, 60/770

See application file for complete search history.

(56) References Cited

U.S. PATENT DOCUMENTS

| | | | | |
|---|---|---|---|---|
| 4,749,029 | A * | 6/1988 | Becker et al. | 165/47 |
| 4,838,030 | A * | 6/1989 | Cramer | 60/753 |
| 5,216,886 | A | 6/1993 | Ewing | |
| 5,339,637 | A * | 8/1994 | Schetter | 60/752 |
| 5,363,654 | A * | 11/1994 | Lee | 60/752 |
| 5,431,020 | A * | 7/1995 | Maghon | 60/753 |
| 5,435,139 | A * | 7/1995 | Pidcock et al. | 60/757 |
| 6,029,455 | A | 2/2000 | Sandelis | |
| 6,397,765 | B1 * | 6/2002 | Becker | 110/336 |
| 6,470,685 | B2 | 10/2002 | Pidcock et al. | |
| 6,675,586 | B2 * | 1/2004 | Maghon | 60/796 |

(Continued)

FOREIGN PATENT DOCUMENTS

EP 0 224 817 B1 6/1987

(Continued)

*Primary Examiner*—Michael Cuff
*Assistant Examiner*—Gerald L Sung

(57) ABSTRACT

The invention relates to a heat shield arrangement for a hot gas (m)-guiding component, which comprises a number of heat shield elements arranged side-by-side on a supporting structure while leaving a gap there between. A heat shield element can be mounted on the supporting structure whereby forming an interior space which is delimited in areas by a hot gas wall to be cooled, with an inlet channel for admitting a coolant into the interior space. According to the invention, a coolant discharge channel is provided for the controlled discharge of coolant from the interior space and, from the interior space, leads into the gap. Coolant can be saved and efficiently used by the specific coolant discharge via the coolant discharge channel, and reduction in pollutant emissions can also be achieved. The heat shield arrangement is particularly suited for linking a combustion chamber of a gas turbine.

15 Claims, 3 Drawing Sheets

U.S. PATENT DOCUMENTS

| | | | | |
|---|---|---|---|---|
| 2001/0005555 | A1* | 6/2001 | Kreis et al. | 428/596 |
| 2002/0116929 | A1* | 8/2002 | Snyder | 60/740 |
| 2003/0010038 | A1* | 1/2003 | Maghon | 60/796 |
| 2003/0182942 | A1* | 10/2003 | Gerendas | 60/752 |
| 2004/0182085 | A1* | 9/2004 | Jeppel et al. | 60/804 |
| 2006/0053798 | A1* | 3/2006 | Hadder | 60/772 |

FOREIGN PATENT DOCUMENTS

| | | | |
|---|---|---|---|
| EP | 0 928 396 | B1 | 7/1999 |
| EP | 1 005 620 | B1 | 6/2000 |
| GB | 849255 | | 9/1960 |
| GB | 2 298 266 | A | 8/1996 |
| WO | WO 98/13645 | A1 | 4/1998 |

* cited by examiner

HEAT SHIELD ARRANGEMENT FOR A COMPONENT GUIDING A HOT GAS IN PARTICULAR FOR A COMBUSTION CHAMBER IN A GAS TURBINE

CROSS REFERENCE TO RELATED APPLICATIONS

This application is the US National Stage of International Application No. PCT/EP2004/008116, filed Jul. 20, 2004 and claims the benefit thereof. The International Application claims the benefits of European Patent application No. EP03018415.4 filed Aug. 13, 2003. All of the applications are incorporated by reference herein in their entirety.

FIELD OF THE INVENTION

The invention relates to a heat shield arrangement for a component guiding a hot gas, which comprises a number of heat shield elements disposed next to each other on a supporting structure with gaps in between. A heat shield element can be mounted on the supporting structure such that an internal space is formed, which is delimited in areas by a hot gas wall to be cooled, with an inlet channel for admitting a coolant into the internal space. The invention also relates to a combustion chamber with an internal combustion chamber lining, which has such a heat shield arrangement, and a gas turbine with such a combustion chamber.

BACKGROUND OF THE INVENTION

The high temperatures in hot gas channels and other hot gas spaces mean that it is necessary for the internal wall of a hot gas channel to be configured with the highest level of temperature-resistance possible. Materials with a high level of heat resistance, such as ceramic materials, are suitable for this purpose. But ceramic materials have the disadvantage that they are both very brittle and they also have unfavorable thermal and temperature conducting characteristics. Metal alloys with a high level of heat resistance and an iron, chromium, nickel or cobalt base are possible alternatives to ceramic materials. As the operating temperature of metal alloys with a high level of heat resistance is however significantly below the maximum operating temperature of ceramic materials, it is necessary to cool metallic heat shields in hot gas channels.

A heat shield arrangement, in particular for structural elements of gas turbine units, is disclosed in EP 0 224 817 B1. The heat shield arrangement is used to protect a supporting structure against a hot fluid, in particular to protect a hot gas channel wall in gas turbine units. The heat shield arrangement has an internal lining made of heat-resistant material, which generally comprises heat shield elements fixed to the supporting structure. These heat shield elements are disposed next to each other leaving gaps for the passage of cooling fluid and are able to move due to thermal influences. Each of these heat shield elements has a top part and a stem part in the manner of a mushroom. The top part is a flat or three-dimensional, polygonal flat element with straight or curved boundary lines. The stem part connects the central area of the flat element to the supporting structure. The top part is preferably triangular in form, so that an internal lining of almost any geometry can be produced using identical top parts. The top parts and optionally other parts of the heat shield elements are made of a material with a high level of heat resistance, in particular a steel. The supporting structure has holes, through which a cooling fluid, in particular air, can be admitted into an intermediate space between the top part and the supporting structure and from there can be admitted through the gaps for passage of the cooling fluid into a spatial area surrounded by the heat shield elements, for example a combustion chamber of a gas turbine unit. This flow of cooling fluid reduces the penetration of hot gas into the intermediate space.

A metallic lining for a combustion chamber is described in U.S. Pat. No. 5,216,886. This lining comprises a number of cube-shaped hollow elements (cells) disposed next to each other, which are welded or soldered to a common metal plate. The common metal plate has precisely one opening assigned to each cube-shaped cell to admit cooling fluid. The cube-shaped cells are disposed next to each other leaving a gap in between. On every side wall in the vicinity of the common metal plate they have a respective opening for the discharge of cooling fluid. The cooling fluid enters the gap between adjacent cube-shaped cells, flows through said gap and forms a cooling film on a surface of the cells, which is oriented parallel to the metal plate and can be exposed to a hot gas. With the type of wall structure described in U.S. Pat. No. 5,216,886 an open cooling system is defined, in which cooling air passes via a wall structure through the cells into the inside of the combustion chamber. The cooling air is then lost for further cooling purposes.

A wall, in particular for gas turbine units, having cooling fluid channels, is described in DE 35 42 532 A1. In the case of gas turbine units the wall is preferably disposed between a hot space and a cooling fluid space. It is joined together from individual wall elements, each of the wall elements being a plate-type body made from material with a high level of heat resistance. Each plate-type body has parallel cooling channels distributed over its base surface, with one end of said cooling channels communicating with a cooling fluid space and the other end with the hot space. The cooling fluid admitted into the hot space and guided by the cooling fluid channels forms a cooling fluid film on the surface of the wall element facing the hot space and/or adjacent wall elements.

A cooling system for cooling a combustion chamber wall is shown in GB-A-849255. The combustion chamber wall is formed by wall elements. Each wall element has a hot gas wall with an outside that can be subject to the action of hot gas and an inside. Nozzles are disposed at right angles to the inside. Cooling fluid in the form of a concentrated flow is discharged from these nozzles and strikes the inside. This cools the hot gas wall. The cooling fluid is collected in a collection chamber and removed from the collection chamber.

To summarize, all these heat shield arrangements, in particular those for gas turbine combustion chambers, are based on the principle that compressor air is used both as the cooling medium for the combustion chamber and its lining and as sealing air. The cooling and sealing air enters the combustion chamber, without having been involved in combustion. This cold air mixes with the hot gas. This causes the temperature at the combustion chamber exit to drop. As a result the output of the gas turbine drops as does the efficiency of the thermodynamic process. This can be compensated for to some extent by setting a higher flame temperature. However this then gives rise to material problems and higher emission values have to be accepted. Another disadvantage of the specified arrangements is that the admission of a not insignificant mass flow of cooling fluid into the combustion chamber causes pressure losses in the air supplied to the burner.

To prevent coolant blowing out into the combustion chamber, complex systems are known with pressurized cooling fluid control, in which the cooling fluid is guided in a closed circuit with a supply system and a return system. Such closed cooling concepts with pressurized cooling fluid control are described for example in WO 98/13645 A1, EP 0 928 396 B1 and EP 1 005 620 B1.

SUMMARY OF THE INVENTION

The object of the invention is to specify a heat shield arrangement, which can be cooled with a coolant, such that little cooling fluid is lost when the heat shield arrangement is cooled. It should be possible to deploy the heat shield arrangement in a combustion chamber of a gas turbine.

This object is achieved according to the invention by a heat shield arrangement for a component guiding a hot gas, which comprises a number of heat shield elements disposed next to each other on a supporting structure with gaps in between. A heat shield element can be mounted on the supporting structure such that an internal space is formed, which is delimited in areas by a hot gas wall to be cooled, with an inlet channel for admitting a coolant into the internal space, with a coolant discharge channel being provided for the controlled discharge of coolant from the internal space, said channel discharging from the internal space into the gap.

The invention is based on the consideration that the very high flame temperatures in hot gas channels or other hot gas spaces, for example in combustion chambers of stationary gas turbines, mean that the components guiding the hot gas have to be actively cooled. A very wide range of cooling technologies—or even combinations thereof—can be used for this purpose. The most frequently used cooling concepts are convection cooling, convection cooling with measures to increase turbulence and impact cooling. Because of the very intensive efforts to reduce pollutant emissions in particular from systems with open cooling, for example combustion chambers with open cooling in gas turbines, cooling air economy is a particularly important factor in achieving these objectives—in this instance greater $NO_x$ reductions. The objective for cooling concepts with open cooling is therefore to minimize the mass flow of cooling air required. With the conventional, open cooling concepts discussed in more detail above, after completing its cooling task the cooling air finally escapes through the gap between adjacent heat shield elements, to enter the combustion chamber. Discharge of the cooling air protects the system from penetration of hot gas into the gaps. The uncontrolled blowing out of the cooling air however means that more cooling air is used to seal the gaps than is required for the cooling task. This increase in quantity leads to excessive cooling air consumption with disadvantageous consequences for the overall efficiency of the unit and pollutant emissions from the combustion system producing the hot gas.

Based on this knowledge with the heat shield arrangement of the invention a controlled and tailored discharge of the coolant for an open cooling system is proposed after completion of the cooling task at the hot gas wall to be cooled. The heat shield arrangement can thereby be implemented particularly simply and is associated structurally with significantly lower manufacturing outlay than closed cooling concepts with coolant return. The controlled coolant discharge into the gap means that coolant, e.g. cooling air, can be used more economically compared with the conventional concepts, whilst at the same time achieving a significant reduction in pollutant emissions, in particular $NO_x$ emissions. This is achieved by providing a coolant discharge channel for the controlled discharge of coolant from the internal space, said channel discharging from the internal space into the gap.

A particularly high level of cooling efficiency and sealing effect of the coolant against the action of a hot gas in the gap on the supporting structure is advantageously achieved in the gap by the tailored and metered application of coolant to the gap. The controlled discharge of coolant from the internal space can thereby be achieved in a simple manner by corresponding dimensioning of the coolant discharge channel, for example in respect of the channel cross-section and the channel length.

In a preferred embodiment the heat shield element has a side wall, which is inclined in the direction of the supporting structure in relation to the hot gas wall. As a result the basic geometry of the heat shield element is configured as a single-shell hollow element, which can be mounted on the supporting structure, thereby forming the internal space. The internal space is thereby delimited or defined in just one direction by the supporting structure and in the other spatial directions by the heat shield element itself.

In a particularly preferred embodiment the coolant discharge channel penetrates the side wall. The coolant discharge channel can thereby be configured simply as a hole through the side wall, with the internal space being connected to the gap space formed by the gap. Coolant can thus be discharged in a controlled manner from the internal space through the coolant discharge channel due to the pressure difference between the internal space and the gap space defined by the gap.

To prevent residual coolant leaks from the internal space, a sealing element is preferably fitted between the side wall and the supporting structure. By inclining the side wall in the direction of the supporting structure, if the heat shield is fixed to the supporting structure in a detachable manner, a gap can be provided for thermomechanical reasons, which can result in unwanted coolant leaks. It is therefore particularly advantageous to seal off those gaps, which may cause an uncontrolled blowing out of coolant from the internal space, using suitable sealing measures. This provides a leak-tight connection between the heat shield element and the supporting structure. The sealing element between the side wall and the supporting structure is thereby a particularly simple but effective measure to reduce coolant consumption further. Also, depending on the embodiment, the sealing element can have a damping function, such that the heat shield elements of the heat shield arrangement are mounted on the supporting structure in a mechanically damped manner.

An impact cooling mechanism is preferably assigned to the internal space of a heat shield element, such that the hot gas wall can be cooled by impact cooling. Impact cooling is thereby a particularly effective method for cooling the heat shield arrangement, with the coolant striking the hot gas wall in a number of discrete coolant jets at right angles to the hot gas wall and cooling the hot gas wall correspondingly from the internal space in an efficient manner.

The impact cooling mechanism is thereby formed by a number of coolant inlet channels, integrated in the supporting structure. A cooling impact mechanism is already provided in a simple manner by a corresponding number of inlet channels discharging into an internal space of a heat shield element. As well as the function of supporting the heat shield arrangement, the supporting structure also has a coolant distribution function via the number of coolant inlet channels integrated in the supporting structure. The inlet channels can thereby be configured as holes in the wall of the supporting structure.

In a preferred embodiment the heat shield element is made of a metal or a metal alloy. Metal alloys with a high level of heat resistance with an iron, chromium, nickel or cobalt base are particularly suitable for this purpose. As metals or metal alloys are particularly suitable for a casting process, the heat shield element is advantageously configured as a cast part.

In a particularly preferred embodiment the heat shield arrangement is suitable for use in a combustion chamber lining of a combustion chamber. Such a combustion chamber provided with a heat shield arrangement is preferably suitable as a combustion chamber of a gas turbine, in particular a stationary gas turbine.

The advantages of such a gas turbine and such a combustion chamber are clear from the above details relating to the heat shield arrangement.

BRIEF DESCRIPTION OF THE DRAWINGS

The invention is described in more detail below based on examples with reference to the schematic and in some instances highly simplified drawings, in which.

The same reference characters have the same significance in the individual figures.

DETAILED DESCRIPTION OF THE INVENTION

Figure 1:
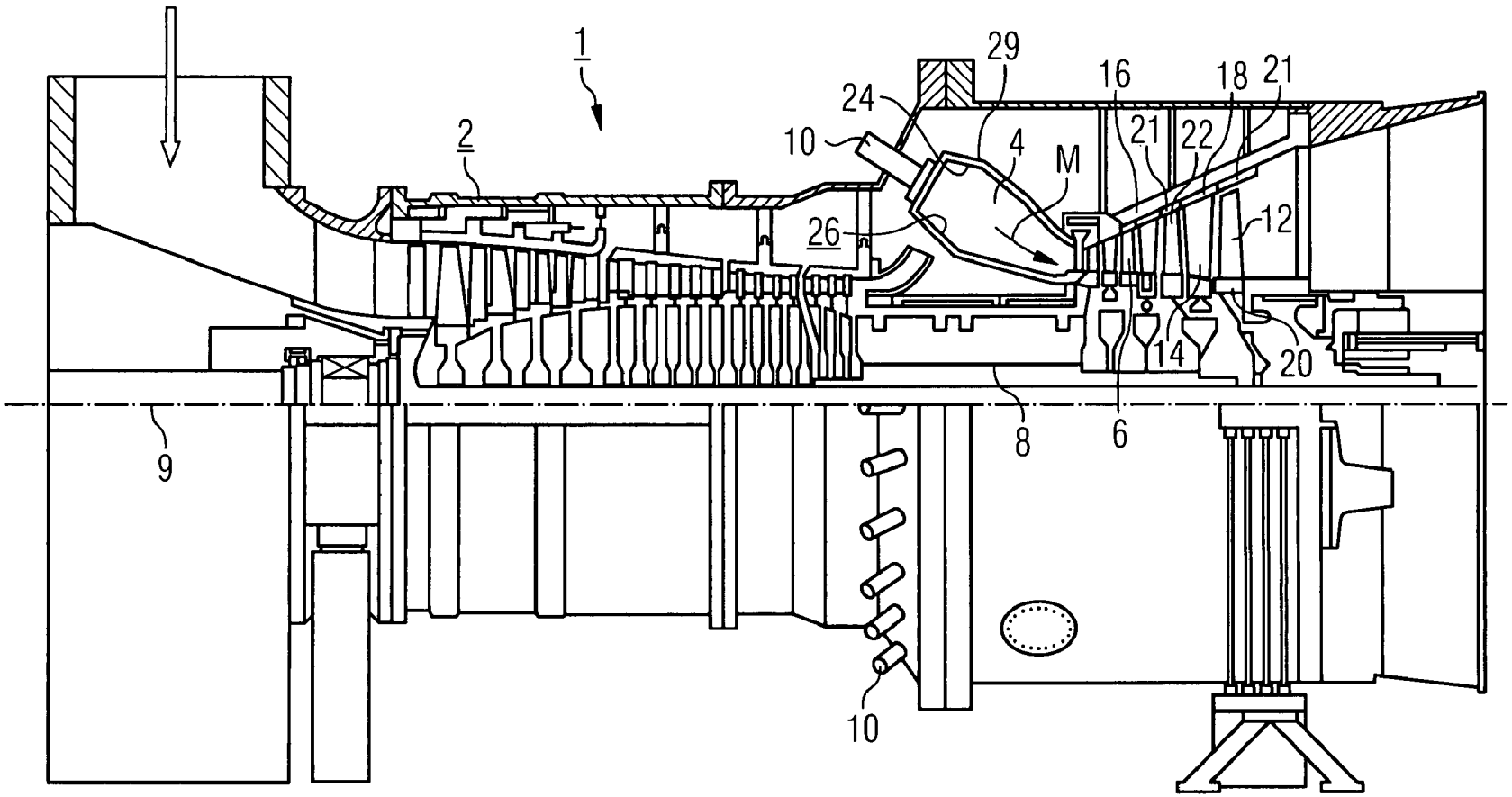
FIG. 1 shows a half section through a gas turbine.

The gas turbine 1 according to FIG. 1 has a compressor 2 for the combustion air, a combustion chamber 4 and a turbine 6 to drive a compressor 2 and a generator or machine (not shown in further detail here). To this end the turbine 6 and compressor 2 are disposed on a common turbine shaft 8 also referred to as a turbine rotor, to which the generator or machine is also connected, and which is supported such that it can be rotated about its central axis 9. The combustion chamber 4 configured in the manner of an annular combustion chamber is fitted with a number of burners 10 to burn a fluid or gaseous fuel.

The turbine 6 has a number of rotating blades 12 connected to the turbine shaft 8. The blades 12 are disposed in a rim shape on the turbine shaft 8, thereby forming a number of rows of blades. The turbine 6 also has a number of fixed vanes 14, which are also fixed in a rim shape, forming rows of vanes on an internal housing 16 of the turbine 6. The blades 12 thereby serve to drive the turbine shaft by pulse transmission of the hot medium flowing through the turbine 6, the working medium or the hot gas M. The vanes 14 on the other hand serve to guide the flow of the working medium M between two successive rows of blades or blade rims when viewed in the direction of flow of the working medium M. A successive pair from a rim of vanes 14 or a vane 3 and from a rim of blades 12 or a row of blades is thereby also referred to as a turbine stage.

Each vane 14 has a platform 18 also referred to as a vane base, which is disposed as a wall element to fix the respective vane 14 to the internal housing 16 of the turbine 6. The platform 18 is thereby a component that is subject to a comparatively high level of thermal loading and forms the outer limit of a hot gas channel for the working medium M flowing through the turbine 6. Each blade 12 is fixed in a similar manner to the turbine shaft 8 via a platform 20 also referred to as a blade base.

A guide ring 21 is disposed on the internal housing 16 of the turbine 6 between the platforms 18 of the vanes 14 of two adjacent rows of vanes, said platforms being disposed at a distance from each other. The outer surface of each guide ring 21 is thereby also exposed to the hot working medium M flowing through the turbine 6 and separated radially from the outer end 22 of the blade 12 opposite by a gap. The guide rings 21 disposed between adjacent rows of vanes thereby serve in particular as cover elements, protecting the internal wall 16 or other integral parts of the housing from thermal overload due to the hot working medium M, the hot gas, flowing through the turbine 6.

The combustion chamber 4 is delimited by a combustion chamber housing 29, with a combustion chamber wall 24 being formed on the combustion chamber side. In the exemplary embodiment the combustion chamber 4 is configured as a so-called annular combustion chamber, whose number of burners 10 disposed in a peripheral direction around the turbine shaft 8 discharge in a common combustion chamber space. To this end the combustion chamber 4 is generally configured as an annular structure, positioned around the turbine shaft 8.

To achieve a comparatively high level of a efficiency, the combustion chamber is designed for a comparatively high temperature of the working medium M of around 1200° C. to 1500° C. To achieve a comparatively long operating life, even with such unfavorable operating parameters for the materials, the side of the combustion chamber wall 24 facing the working medium M is provided with a heat shield arrangement 26, which forms a combustion chamber lining. Because of the high temperatures inside the combustion chamber 4 a cooling system is also provided for the heat shield arrangement 26. The cooling system is thereby based on the principle of impact cooling, in which cooling air is blown under pressure as the coolant K at sufficiently high pressure at a number of points onto the component to be cooled at right angles to its component surface. Alternatively the cooling system can also be based on the principle of convective cooling or can make use of this cooling principle in addition to impact cooling.

The cooling system is designed to be of simple structure for reliable application of coolant K to a large area of the heat shield arrangement and also for the lowest possible coolant consumption.

Figure 2:
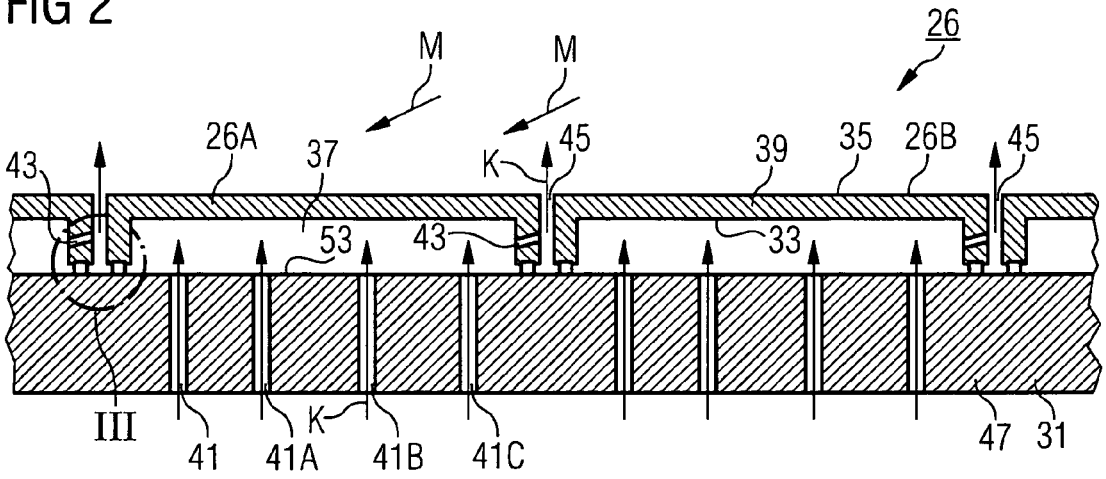
FIG. 2 shows a sectional view of a heat shield arrangement according to the invention.

To illustrate and describe the cooling concept of the invention in more detail, FIG. 2 shows a heat shield arrangement 26, which is particularly suitable for use as a heat-resistant lining of a combustion chamber 4 of a gas turbine 1. The heat shield arrangement 26 comprises heat shield elements 26A, 26B, which are disposed next to each other on a supporting structure 31 leaving gaps 45. The heat shield elements 26A, 26B have a hot gas wall 39 to be cooled, which has a hot side 35 facing the hot gas M and subject to the action of the hot gas M during operation and a cold side 33 opposite the hot side 35.

For cooling purposes the heat shield elements 26A, 26B are cooled from their cold side 33 by a coolant K, for example cooling air, which is delivered to the internal space 37 formed between the heat shield elements 26A, 26B and the supporting structure 31 via suitable inlet channels 41, 41A, 41B, 41C and guided in a direction at right angles to the cold side 33 of a respective heat shield element 26A, 26B. The principle of open cooling is used here. After completion of the cooling task at the heat shield elements 26A, 26B, the at least partly warmed air is mixed with the hot gas M. For controlled discharge and precise metering of coolant K from the internal space, a coolant discharge channel 43 is provided, which discharges from the internal space 37 into the gap 45. This means that a precisely predefinable mass flow of coolant K can be delivered to the gap 45. The number of inlet channels 41, 41A, 41B, 41C, each assigned to an internal space 37 of a respective heat shield element 26A, 26B, form an impact cooling mechanism 53, such that the hot gas wall 39 can be cooled particularly effectively by means of impact cooling. The inlet channels 41, 41A, 41B, 41C for the coolant K are hereby integrated by means of corresponding holes in the wall 47 of the supporting structure. The inlet channels 41, 41A, 41B, 41C thereby discharge into the internal space 37 such that the coolant strikes the hot gas wall 39 at right angles. After the hot gas wall 39 has been undergone impact cooling, the coolant K is discharged from the internal space 37 in a controlled manner through the correspondingly dimensioned coolant discharge channel 43 into the gap 45, where a sealing effect is achieved in respect of the hot gas M, protecting the critical components, such as the supporting structure 31.

Figure 3:
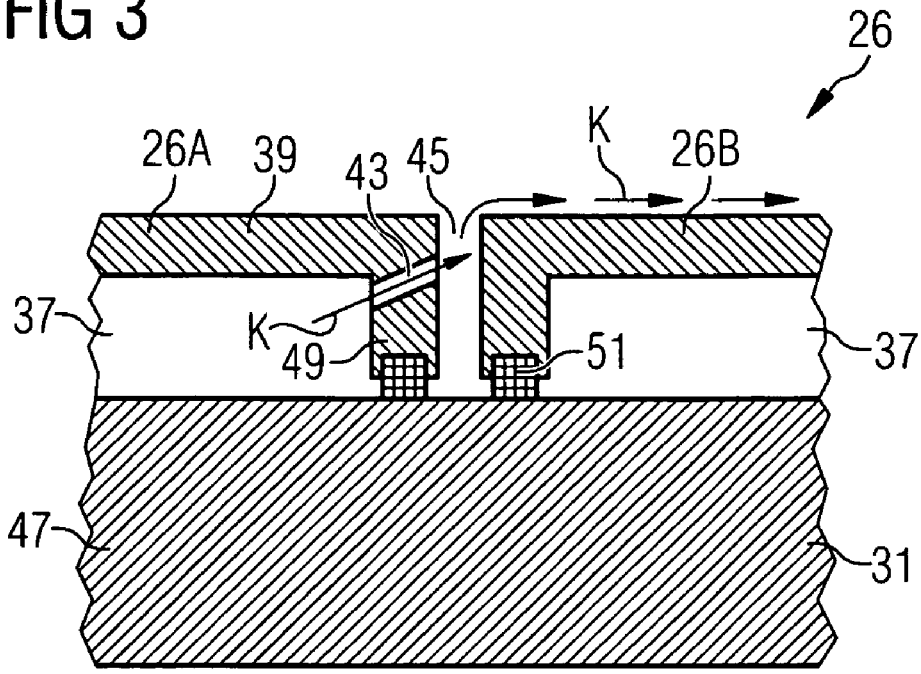
FIG. 3 shows a detailed view of the detail III in the heat shield arrangement shown in FIG. 2.

FIG. 3 shows an enlarged illustration of the detail III in the heat shield arrangement shown in FIG. 2. The heat shield element 26A has a side wall 49, which is inclined in the direction of the supporting structure 31 in relation to the hot gas wall 39. The heat shield element 26B disposed adjacent to the heat shield element 26A is configured in the same manner with a side wall 49. The coolant discharge channel 43 is configured as a hole through the side wall 43 of the heat shield element 26A, which discharges through the side wall 43 at an oblique angle rising slightly in the direction of the hot side into the gap 45. The oblique discharge means that, after establishing a sealing effect in the gap 45, the coolant K leaves the gap 45, where possible forming a cooling film of coolant K along the hot side 35 of the heat shield element 26B adjacent to the heat shield element 26A. This additional film cooling effect, achieved with the tailored supply of the coolant K into the gap 45, advantageously means that the coolant K is used in a multiple manner for different cooling purposes in the heat shield arrangement 26.

So that the heat shield elements 26A, 26B can be fixed in a manner that is tolerant of thermal expansion, the side walls 49 are not in direct contact with the supporting structure 31 but are connected to the supporting structure 31 via a respective sealing element 51. The sealing elements thereby satisfy both a sealing function for the coolant K and a mechanical damping function for the heat shield arrangement 26. The sealing element 51 means that the coolant K cannot pass from the internal space 37 into the gap 45 in an uncontrolled manner and be blown in the direction of the hot side 35. Rather the sealing element 51 brings about an additional reduction in the quantity of coolant K needed to cool the heat shield arrangement 26. The combination of sealing element 51 and coolant discharge channel 43 allows a particularly favorable coolant balance to be achieved. Also a longitudinal flow along the bottom of the wall 47 of the supporting structure 31 facing the internal space 37 is achieved by means of the sealing elements 51 assigned respectively to the internal space 37. The leak-tight connection between the heat shield element 26A, 26B and the supporting structure 31 via the sealing element 51 is a particularly simple and effective measure for reducing coolant consumption further.

Figure 4:
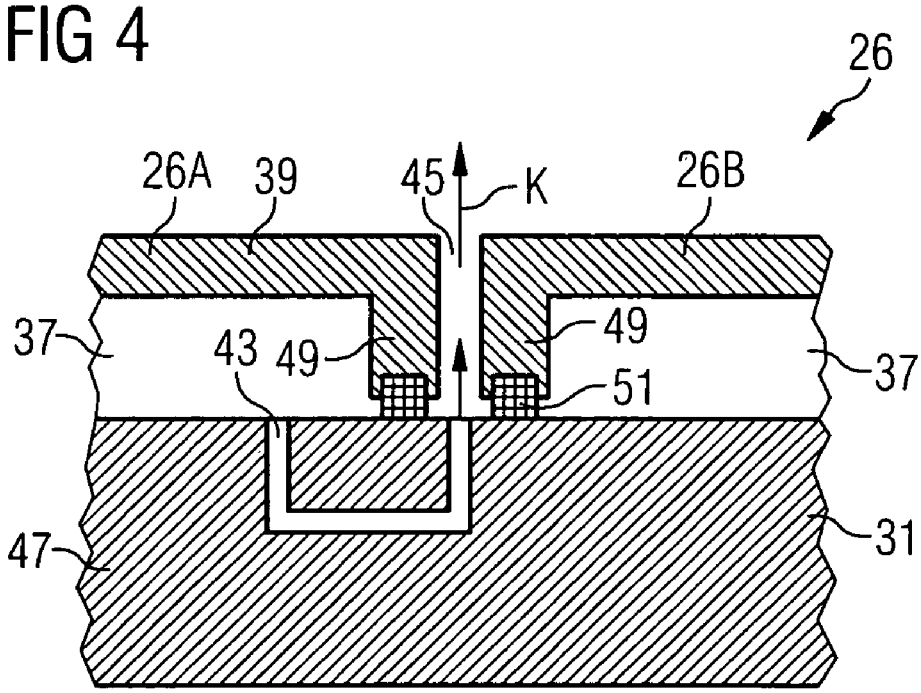
FIG. 4 shows an alternative embodiment of the heat shield arrangement shown in FIG. 3.

It is also possible, although more complex from a manufacturing point of view—as shown in FIG. 4—for the coolant discharge channel 43 to extend through the wall 47 of the supporting structure 31. This embodiment also allows tailored delivery of the coolant K into the gap 45 after completion of the cooling task at a heat shield element 26A. The gap 45 and the sealing elements 51 delimiting the gap 45 in the vicinity of the discharge point of the coolant discharge channel 43 are cooled as a result. In particular the side walls 49 delimiting the gap 45 are also cooled by convection.

The invention claimed is:

1. A heat shield for guiding a hot gas, comprising:

a support structure having an inlet channel for a coolant flow;

a plurality of heat shield elements mounted to the support structure, each heat shield having a hot gas wall in contact with the hot gas and a plurality of side walls which extend from the hot gas wall toward the supporting structure to form an internal space that receives the coolant flow;

a plurality of cooling gaps formed by spaces between adjacent heat shields;

a sealing element which provides mechanical damping that is arranged between the supporting structure and the side walls, said side walls and said supporting structure being connected through the sealing element, said side walls not being in direct contact with said supporting structure; and a coolant discharge channel that is formed within a portion of the support structure so as to direct the coolant flow from the internal space under the sealing element to the cooling gaps.

2. The heat shield structure as claimed in claim 1, wherein the internal space side of the hot gas wall is cooled by impact cooling.

3. The heat shield structure as claimed in claim 2, wherein the supporting structure contains a plurality of inlet channels.

4. The heat shield structure as claimed in claim 3, wherein the heat shield element comprises a metal or a metal alloy.

5. The heat shield structure as claimed in claim 4, wherein the heat shield element is selected from the group of superalloy based materials consisting of iron, chromium, nickel and cobalt.

6. The heat shield structure as claimed in claim 5, wherein the heat shield is formed by a cast process.

7. The heat shield structure as claimed in claim 6, wherein the coolant discharge channel is formed in the side wall of the heat shield.

8. A combustion chamber for a gas turbine engine, comprising:

a burner through which a hot gas flows; and a heat shield structure located downstream of the burner and attached to an interior wall of the combustion chamber for guiding the hot gas flow, comprising:

a support structure having a plurality of inlet channels that provides an impact cooling flow;

a plurality of temperature resistant cast superalloy elements secured to the support structure, the temperature resistant elements have a surface in contact with the hot gas and a plurality of side walls which extend from the surface toward the support structure to form an internal region which directly receives the impact coolant flow;

a plurality of cooling gaps formed by spaces between adjacent heat shields;

a sealing element arranged between the supporting structure and the side walls that inhibits leakage of the coolant flow and damps the heat shield structure in order to inhibit vibration induced by the hot gas flow; and a coolant flow discharge channel that is formed within a portion of the support structure so as to direct the coolant flow from the internal region under the sealing element to the cooling gaps;

wherein said side walls and said supporting structure are connected through the sealing element, and said side walls are not in direct contact with said supporting structure.

9. The combustion chamber as claimed in claim 8, wherein the superalloy base is selected from the group consisting of iron, chromium, nickel and cobalt.

10. The combustion chamber as claimed in claim 8, wherein all of the temperature resistant elements have a surface in contact with the hot gas.

11. The combustion chamber as claimed in claim 8, wherein the coolant discharge channel is formed in the side wall of the temperature resistant element.

12. A gas turbine engine, comprising:

a compressor that provides a compressed air flow;

a turbine arranged downstream of the compressor; and a combustion chamber having:

a support structure with a plurality of inlet channels that provides an impact coolant flow;

a plurality of temperature resistant cast superalloy elements secured to the support structure, the temperature resistant elements have a surface in contact with the hot gas and a plurality of side walls which extend from the surface toward the support structure to form an internal region which directly receives the impact coolant flow;

a plurality of cooling gaps formed by spaces between adjacent heat shields;

a sealing element arranged between the supporting structure and the side walls that inhibits leakage of the coolant flow and damps the heat shield structure; and a coolant flow discharge channel that is formed within a portion of the support structure so as to direct the coolant flow from the internal region under the sealing element to the cooling gaps;

wherein said side walls and said supporting structure are connected through the sealing element, and said side walls are not in direct contact with said supporting structure.

13. The gas turbine engine as claimed in claim 12, wherein the superalloy base is selected from the group consisting of iron, chromium, nickel and cobalt.

14. The combustion chamber as claimed in claim 12, wherein all of the temperature resistant elements have a surface in contact with the hot gas.

15. The combustion chamber as claimed in claim 12, wherein the coolant discharge channel is formed in the side wall of the temperature resistant element.

* * * * *